US007320641B2

(12) United States Patent
Luciano, Jr.

(10) Patent No.: US 7,320,641 B2
(45) **Date of Patent: *Jan. 22, 2008**

(54) METHOD AND SYSTEM FOR INCREASING PLAYER PARTICIPATION OF A GAMING DEVICE

(75) Inventor: Robert Luciano, Jr., Reno, NV (US)

(73) Assignee: Sierra Design Group, Las Vegas, NV (US)

( * ) Notice: Subject to any disclaimer, the term of this patent is extended or adjusted under 35 U.S.C. 154(b) by 187 days.

This patent is subject to a terminal disclaimer.

(21) Appl. No.: 11/097,484

(22) Filed: Apr. 1, 2005

(65) Prior Publication Data

US 2005/0181865 A1 Aug. 18, 2005

Related U.S. Application Data

(63) Continuation of application No. 10/364,874, filed on Feb. 12, 2003, now Pat. No. 6,875,107.

(60) Provisional application No. 60/356,990, filed on Feb. 12, 2002.

(51) Int. Cl.
*A63F 9/24* (2006.01)

(52) U.S. Cl. ..... 463/25

(58) Field of Classification Search ..... 463/16–22, 463/25–26; 273/143 R
See application file for complete search history.

(56) References Cited

U.S. PATENT DOCUMENTS 5,816,918 A 10/1998 Kelly et al.
6,875,107 B1 * 4/2005 Luciano, Jr. ..... 463/25
2003/0078101 A1 4/2003 Schnelder et al.

* cited by examiner

*Primary Examiner*—Kim Nguyen
(74) *Attorney, Agent, or Firm*—Steptoe & Johnson LLP

(57) ABSTRACT

A system and method are set form for increasing a players participation and entertainment value in the play of a gaming device such as a slot machine. The system and method includes offering a prize award such as a product or service for the player obtaining a predetermined outcome such as a jackpot. The prize has an acquisition cost (A) to the game operator who assigns to the prize a pay table value (B) for calculation and configuring the performance of the gaming device. The player attributes a value (C) to the prize. The system and method are configured such that (A)≦(B)<(C).

12 Claims, 2 Drawing Sheets

METHOD AND SYSTEM FOR INCREASING PLAYER PARTICIPATION OF A GAMING DEVICE

CROSS-REFERENCE TO RELATED APPLICATION

This application is a continuation of U.S. patent application Ser. No. 10/364,874, filed Feb. 12, 2003, now U.S. Pat. No. 6,875,107, which is a utility conversion application for and claims priority to commonly owned and prior filed application Ser. No.: 60/356,990 filed Feb. 12, 2002 and titled "A Method and System for Increasing Player Participation of a Gaming Device".

FIELD OF THE INVENTION

The present invention is directed to gaming methods and systems and, more particularly, to gaming devices and systems which provide prizes in the form of tangible goods or instruments redeemable for tangible goods or for a right to services.

BACKGROUND

Gaming devices such as slot machines and other video forms of gaming devices (e.g., video poker, video keno, video slots, etc.) are known. In general, a gaming device allows a player to play a game in exchange for a wager (a monetary amount placed at risk). Depending on the outcome of the game, the player may be entitled to an award which is paid to the player by the gaming device, normally in the form of currency or game credits.

For example, a conventional slot machine contains a plurality of wheels, each wheel bearing a set of symbols. The configuration of symbols on each wheel determines a probability of obtaining any particular combination of symbols when playing the machine. Each combination is mapped, or associated with, an award. The machine includes, implicitly or explicitly, a "pay table" which shows the award associated with each combination. When a player achieves a given combination, the machine maps that combination to the appropriate award (which may be zero), and pays the player accordingly. The wheel or reels of a slot machine may be convention physical reels or may be a video representation of reels displayed on a display device or monitor.

Pay tables associated with the game define the award amounts corresponding to matching symbols on pay lines. An illustrative pay table for a three-reel arrangement is shown in Table 1.

TABLE 1

| Symbol | Award |
|---|---|
| 777 | 25 |
| BBB | 10 |
| CCC | 5 |
| MMM | 3 |
| Mixed | 0 |

The pay table of Table 1 shows the award associated with each symbol. The term "mixed" refers to all combinations not explicitly shown. It is assumed that on each play, the player wagers at least one unit, and the award is measured in terms of the same units. Of course, a game may be structured such that more than one unit can be wagered at one time, in which case the awards can be multiplied by the number of units wagered.

In the above example, there are five possible awards, namely 25, 10, 5, 3, and 0. The likelihood a particular award event will occur during the course of play is normally defined by a probability distribution. For example, the probability of obtaining each possible award could be determined according to the distribution shown in Table 2:

TABLE 2

| Award | Probability |
|---|---|
| 25 | .01 |
| 10 | .03 |
| 5 | .05 |
| 3 | .06 |
| 0 | .85 |

In the example probability distribution of Table 2, the likelihood of obtaining a symbol combination of 777 (having an associated award of 25), also sometimes referred to as "hit frequency", is 1 in 100 games. Likewise, the likelihood of obtaining a symbol combination of BBB (having an award of 10) is a hit frequency of 3 in 100 games; the likelihood of obtaining a symbol combination of CCC (having an award of 5) is a hit frequency of 5 in 100 games; the likelihood of obtaining a symbol combination of MMM (having an award of 3) is a hit frequency of 6 in 100 games; the likelihood of obtaining a mixed-symbol combination (having an award of zero (0)) is 85 in 100 games. According to this example, the mean award would be 0.98, with a standard deviation of about 3.17. Thus, when a player wagers one unit, the expected payback is 0.98 units. Through appropriate random number generators, the gaming device derives a combination of symbols which is displayed to the user, and this symbol combination is mapped to an award which is then paid to the player.

By so constructing the award pay out for each winning outcome and its hit frequency (probability of occurrence), the overall performance for the gaming device can be defined. By summing the product of hit frequency and award for outcomes, the device's performance can be defined. Thus the device's performance ($P_X$) may be represented by the following expression, $$\sum(\text{hit frequency} \times \text{award})$$

For example, when it is said that a gaming device has a performance of a 98% pay back machine, than means that multiplying the hit frequency for each outcome times the award and summing those products, the performance $P_X$ can be defined such that for every unit wagered, the device statistically should pay back 0.98 units.

In order to increase revenue for the operation of gaming devices, various means for increasing player interest and participation in gaming devices have been attempted. For example, U.S. Pat. No. 5,397,125 to Adams discloses a gaming device which dispenses awards in the multiple forms: one form is currency and another form of payout comprises tokens formed of a precious metal such as silver and/or gold. Each token award would have a corresponding entry in the pay table equivalent to the value of the token award. Under this arrangement, the pay table would be modified to include pay outs for the token awards. Thus an illustrative modified pay table would look like Table 3.

TABLE 3

| Symbol | Award |
|---|---|
| 777 | Gold Token |
| BBB | Silver Token |
| CCC | 5 |
| MMM | 3 |
| Mixed | 0 |

In Table 3, the Gold Token award substitutes for the 25 unit award (of Table 1), and the Silver Token award substitutes for the 10 unit award (of Table 1). A corresponding modified probability table is illustrated in Table 4.

TABLE 4

| Award | Probability |
|---|---|
| Gold Token | .01 |
| Silver Token | .03 |
| 5 | .05 |
| 3 | .06 |
| 0 | .85 |

Since the Gold Token award has an equivalent value of 25 units, and the Silver Token award has an equivalent value of 10 units, the overall payback probability in terms of "unit value" is the same as that of Table 2, namely 0.98 (i.e. a 98% pay back machine).

SUMMARY OF THE INVENTION

The present invention provides a method and system for increasing play of gaming devices which overcome the deficiencies in the prior art. In general, the present invention provides means for increasing player participation in gaming devices by providing a perceived increase in payback to the player.

The system and method of the present invention allows a player to play a game in exchange for a wager amount. Pursuant to game winning events, the gaming device may award a player currency unit awards or tangible prize awards. According to the invention, for each tangible prize award, there is an operator purchase or acquisition cost (A), an assigned pay-table value (B), and a player perceived prize value (C).

The operator acquisition cost (A) is the cost to the game device operator for acquisition of the tangible prize(s). Due to the operator's purchasing power, the acquisition cost (A), which is normally measured at wholesale cost, is normally substantially lower than the player perceived prize value (C), which is normally measured at the market or retail value. The pay-table value (B) is generally defined as the amount equivalent to the unit award as dispensed by the game device pursuant to award winning events. In the prior art, the pay-table assigned award value (B) is generally equivalent to the player perceived prize value C. In some cases in the prior art, the pay-table assigned value (B) actually exceeds the player perceived prize value (C), for example when the prize dispensed is a memorabilia token having little precious metal content.

However, according to the present invention, the pay-table value (B) is assigned a substantially lower cost value than the player perceived prize value (C) in the pay table to define device performance of $P_1$. According to some embodiments, the pay-table value (B) may be assigned the same cost as the operator purchase cost (A), while in other embodiments the pay-table value (B) may be any cost lower than the player perceived prize value (C) and higher than the operator purchase prize cost (A) to satisfy the expression $$(A) \leqq (B) < (C).$$

Thus if a prize X has an operator purchase cost (A) equivalent to $20 and a player perceived prize value (C) equivalent to $35, the pay-table value B may be assigned a value less than $35, such as $25 for determination of the device performance $P_1$. By substituting Prize X as the 25 unit award in the example Table 1, and using the probability chart of Table 2 having a projected payback of 0.98, a combined pay table/probability chart may be constructed as shown in Table 5 for a one dollar ($1) unit game.

TABLE 5

| Symbol | Award | Probability |
|---|---|---|
| 777 | Prize X | .01 |
| BBB | 10 | .03 |
| CCC | 5 | .05 |
| MMM | 3 | .06 |
| Mixed | 0 | .85 |

Under this arrangement, the player perceived price value of Prize X is $35. Although the Prize. X is assigned a $25 prize cost to the pay table, the perceived payback to player is substantially higher (approximately 1.08) since the player perceived a higher price value. Thus, for each dollar wagered, the perceived expected payback to the user in this example, or performance $P_2$, 1.08. For less mathematical players, the issuance of prize X having a player perceived value of $35 instead of a cash prize of $25 can substantially increase player satisfaction by creating a general impression in the player that this game has a higher-than-normal win, or payback.

According to the game arrangement of the present invention, the player will generally overlook the reduced resource for funding/investing in later games due to the increase in overall perceived payback probability as described above. Additionally, the player's "perceived payback" is which is normally reduced in non-credit unit awards is off-set by the arrangement of a higher perceived payback by defining lower price cost values. Thus, player interest, participation and excitement according to the present invention is increased, thereby increasing overall revenue for the casino operator.

BRIEF DESCRIPTION OF THE DRAWINGS

These and other features and advantages of the present invention will become better understood with reference to the description, claims and drawings wherein:

DESCRIPTION

Figure 1:
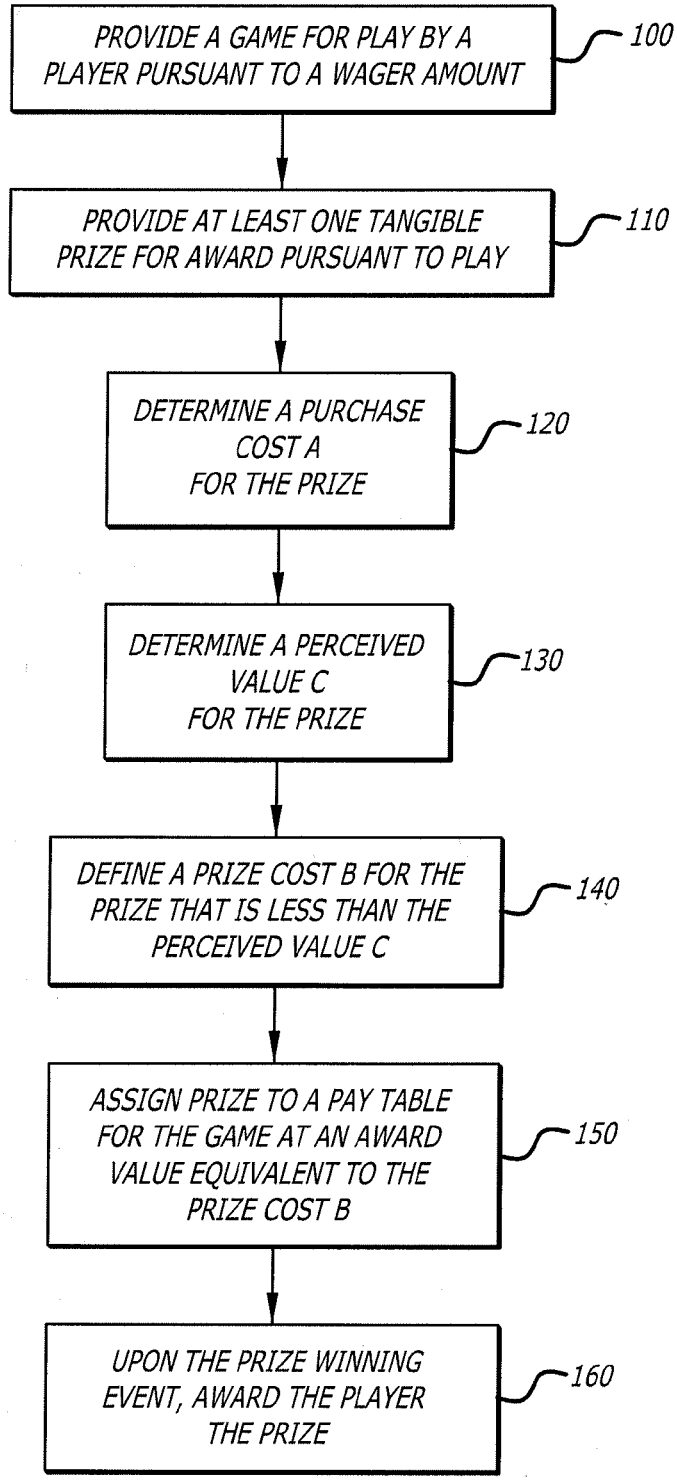
FIG. 1 depicts generally the acts associated with carrying out the present invention for increasing player participation.

Turning to FIG. 1, at block 100, a gaming device 200 is provided to the player to allow a player to play the game in exchange for a wager amount. Such gaming device 200 generally comprises hardware and software for playing a game of chance in a casino environment, such a slot machine, video poker machine, video keno machine, for example. The gaming device may also comprise a player terminal for play in a video lottery game environment, where game events are determined from random draws from a finite or fixed pool of game outcomes.

Figure 2:
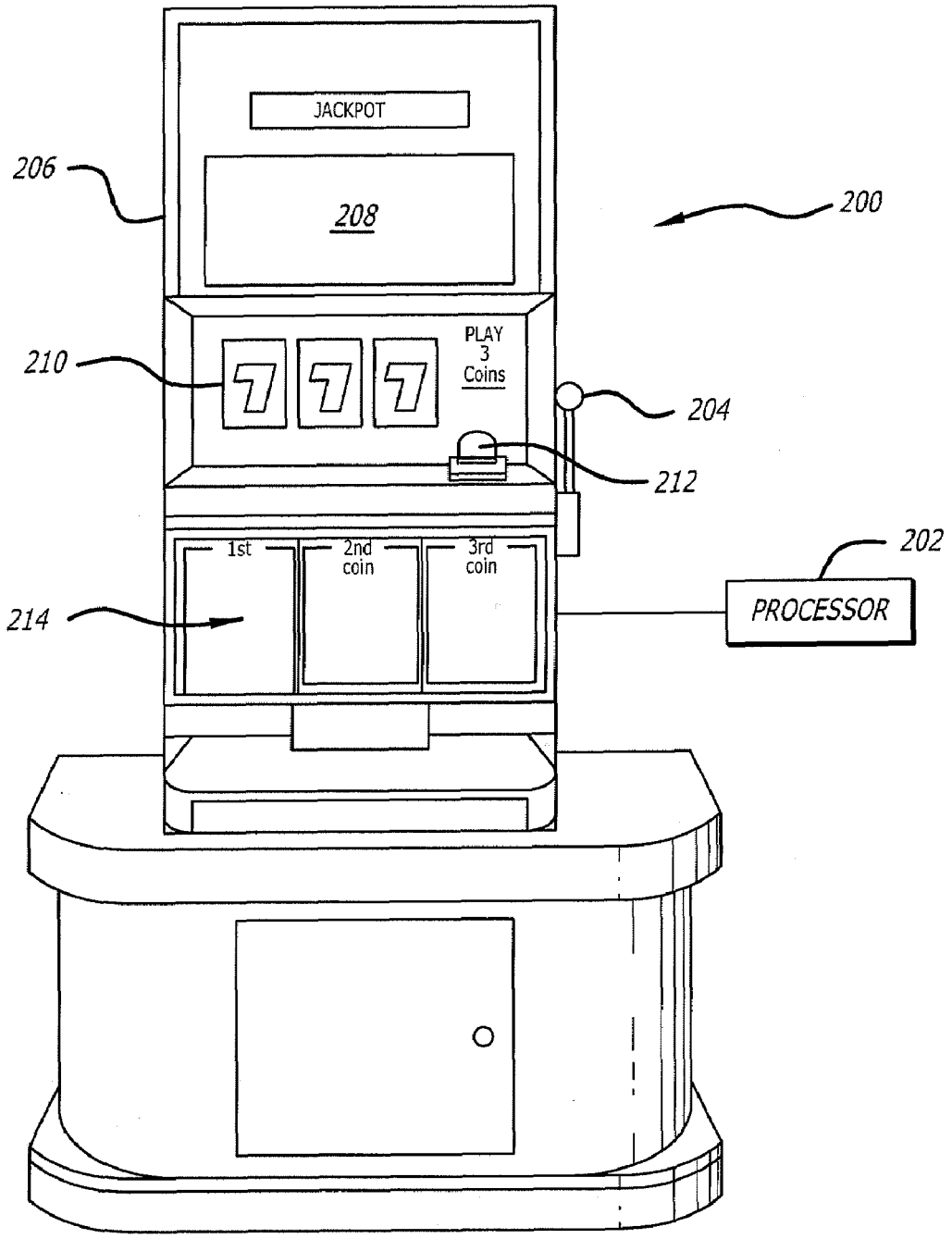
FIG. 2 shows and example of a gaming device incorporating features of the present invention.

While the present invention is suited for casino games based upon random chance, the present invention could also be used in conjunction with games incorporating skill such as video games, arcade games and the like. With reference to FIG. 2, the gaming device 200 includes a processor 202 for executing the game and memory for storage and retrieval of a game data. The gaming device 200 also generally includes input/output (I/O) devices for communication to the player, such as player controls, video output devices, sound output devices, for example. As depicted in FIG. 2, the (I/O) devices may be embodied as a handle 204 which the player, in a well known fashion, pulls to prompt play of the game. The gaming device 200 may also be coupled for communication to a network to communication with other systems, such as accounting servers, player tracking server, and prize servers, for example.

Continuing with FIG. 2, the device 200 is generally shown to have a housing 206 which contains the processor 202 and which may support a tangible prize display 208 which displays the tangible prize(s) offered for the game. A game display 210 displays the game play indicia such as, as shown, game play reels. The game display 210 may be a display of mechanical elements, e.g. reels, or may be embodied as a video display. For purposes of illustration, the game display 210 is shown as a display of electro-mechanical reels.

The device 200 also includes means for accepting a wager. These means may be embodies as a token acceptor 212 as shown in FIG. 2. Alternatively or additionally, these wager acceptance means may be embodied as a cash/script/voucher validator and reader, credit or debit card reader or the like. Thus the player may make a monetary or monetary equivalent wagers to play the device 200. As is known, the device 200 may also include a credit meter (not shown) to accumulate and register game play credits for play of the device 200.

Disposed on the device 200 is a pay out schedule 214 which may be broken down into segments based upon the player's game wager. The schedule 214 displays all winning outcomes and the awards for each for the player to confirm awards and to meet regulatory dictates.

Not shown in FIG. 2 are means for dispensing a tangible prize award to the player. Thee means may include means to physically transfer the tangible award, e.g. an item of jewelry, gold piece, voucher, certificate or the like from the tangible prize display 208 or they may be embodied as a voucher printer to print a ticket or voucher for the player to claim their prize elsewhere. Still further, these means may be embodied as dispensing a token or instrument redeemable for the tangible prize or by hand delivery of the prize to the player by an attendant or delivery by courier.

Returning to FIG. 1, at block 110, at least one tangible prize X is provided for award to the player pursuant to a defined prize-winning event occurring during play of the game. The event may be based upon an outcome being obtained at the game display 210 or pursuant to an outcome as a result of a bonus game.

At block 120, an operator purchase or acquisition cost (A) is determined for the prize X. As described above, due to the operator's buying power, the acquisition cost (A) will typically be on the order of wholesale pricing for the prize X.

At block 130, the prize X is selected to have a player perceived prize value (C) which is greater than the acquisition cost (A). The perceived value (C) can be defined by techniques such as appraisal, survey or opinion evidence. The perceived prize value (C) is generally on the order of retail pricing for the prize X. For such items as jewelry, for example, player perceived prize value (C) may be determined by easily from an appraisal by a jeweler.

At block 140, a pay-table value (B) for the prize X is defined, the pay-table value (B) being less than the player perceive prize value C. In some cases, the pay-table value (B) may be equivalent to the operator purchase cost (A). Thus the relationship of the acquisition cost (A), pay table value (B) and player perceived value (C) follows generally the following expression, $$(A) \leqq (B) < (C)$$

At block 150, the prize is assigned to the pay table for the game at an award value equivalent to the operator or game defined pay table value B determined in block 140.

The assignment of the pay table value (B) to the tangible prize and the inclusion of the tangible prize in the pay table schedule defines a performance for the device 200 of $P_1$. For example, if the tangible prize has an acquisition cost (A) of \$100, a player perceived value of \$200, the tangible prize may be assigned a pay table value (undisclosed to the player) of \$150. Based upon the calculation of winning outcomes, hit frequencies and assigned awards, the assignment of \$150 to value (B) may define a device 200 having a performance $P_1$ (which may be expressed as the pay out percentage) of 0.98. Thus, based upon outcome probabilities and the awards assigned to winning outcomes, for every \$100 the player wagers, they should win awards of \$98.

However, if the player perceived value (C) is used instead of the pay table assigned value (B), the device performance is $P_2$, which is greater than $P_1$ by virtue of the fact that the tangible award value(s) are higher. The player perceived higher performance $P_2$ may exceed 100% making the game more enticing to the player.

At block 160 of FIG. 1, upon the occurrence of the defined tangible prize winning event, the player is awarded tangible prize X. The player, having received the tangible prize X, makes either an informal evaluation of its value or a formal evaluation of its value (i.e., uses an appraiser). A players' informal or formal evaluation of the value of prize X now-adds to each players' perception of the total value received from the game being played. For a more formal player, this may include an approximation of the game's overall payback (from the player's perspective) by including the player perceived value of tangible prize X in the game's perceived player payback. For less formal players, the player perceived value of prize X adds to the generalized impression of getting more back for your money than is possible from games which award only cash prizes. However each individual player assess the perceived value of tangible prize X, the present invention provides for increased game play, player interest, and player satisfaction by creating a player perception of increased game payout not previously available.

While the tangible prize award may be issued at the machine, in an alternative or additional embodiment, the available tangible prizes may be displayed at a touch screen video display for the player to select. At that point, either the machine would dispense the selected prize or the prize would be delivered by an attendant or the machine would dispense a voucher for the player to use to collect their prize. Alternatively, the prize, where the winner is a hotel guest, the prize could be delivered to the guest's room. Still further, the displayed prize selection could represent prizes offered by a third party merchant, i.e. catalog selections, whereby the player's selection would be transformed into a dispensed product order for the player to mail or travel to a store to collect the selected prize. Even further, the dispensed voucher may represent information for the player to select qualifying prizes from an Internet vendor for shipment to the player.

As still a further embodiment, the player upon qualifying for the prize may select between being awarded an amount of game credits or the token prize. If the player elects the game credits, the same would be summed into the inventory of the player's game credits.

While I have referred to the prize award as a tangible prize it should be understood that such a term was meant to distinguish between a monetary award where all values (A), (B), and (C) are known and fixed, e.g. cash tokens, cash vouchers, cash value credits. The prize described herein could be anything such as goods or services, e.g. housekeeping services, airline travel, where the device operator can purchase the product/services at a value (A), assign to the product/services a greater pay table value (B) and where the player would perceive the product/services to have even a greater value (C).

While I have shown and described certain embodiments of the present invention it should be understood that it is subject to many modifications without departing from the spirit and scope of the claims.

I claim:

1. A method for increasing player participation in a gaming device, comprising: providing a game having a hit frequency for each winning outcome;

assigning a non-monetary prize to each winning outcome, the prize having a player perceived value greater than an acquisition cost of the prize, and wherein the player perceived value is a monetary value the player associates with the non-monetary prize; and configuring the gaming device to increase player participation in the gaming device, wherein a player-perceived performance value of the gaming device is greater than a device performance value of the gaming device, wherein the player-perceived performance value is a sum of a product of the hit frequency for each winning outcome and the player perceived value, and the device performance value is a sum of a product of the hit frequency for each winning outcome and an assigned pay table value.

2. The method of claim 1, further comprising assigning a pay table value to the non-monetary prize.

3. The method of claim 2, wherein the assigned pay table value is greater than the acquisition cost of the non-monetary prize, and the player perceived value is greater than the assigned pay table value.

4. The method of claim 2, wherein the assigned pay table value is greater than or equal to the acquisition cost of the non-monetary prize, and the player perceived value is greater than the assigned pay table value.

5. The method of claim 1, further comprising providing a means for dispensing to the player the non-monetary prize or a voucher redeemable for the non-monetary prize.

6. A method for increasing player participation in a game device, comprising: providing a game having a hit frequency for each winning outcome;

assigning a non-monetary prize to each winning outcome, the prize having an acquisition value less than or equal to a pay table value, and a player perceived value greater than the pay table value; and configuring the gaming device to increase player participation in the gaming device, wherein a player-perceived performance value of the gaming device is greater than a device performance value of the gaming device.

7. The method of claim 6, wherein the player-perceived performance value is a sum of a product of the hit frequency for each winning outcome and the player perceived value.

8. The method of claim 7, wherein the device performance value is a sum of a product of the hit frequency for each winning outcome and the assigned pay table value.

9. The method of claim 6, further comprising providing a means for dispensing to the player the non-monetary prize or a voucher redeemable for the non-monetary prize.

10. A method for increasing player participation in a gaming device, comprising:

providing a game having a hit frequency for each winning outcome;

assigning a non-monetary prize to at least one winning outcome;

setting an acquisition value and an assigned pay table value for the non-monetary prize, wherein a player perceived value of the prize is a monetary value the player associates with the non-monetary prize, and wherein the player perceived value is greater than the acquisition value and the assigned pay table value;

configuring the gaming device to increase player participation in the gaming device, wherein a player-perceived performance value of the gaming device is greater than a device performance value of the gaming device; and providing a means for dispensing to the player the non-monetary prize or a voucher redeemable for the non-monetary prize.

11. The method of claim 10, wherein the player-perceived performance value is a sum of a product of the hit frequency for each winning outcome and the player perceived value.

12. The method of claim 10, wherein the device performance value is a sum of a product of the hit frequency for each winning outcome and the assigned pay table value.

* * * * *